United States Patent [19]

Jordan et al.

[11] 4,146,177

[45] Mar. 27, 1979

[54] ELECTROSTATIC FLOCKING SYSTEM

[75] Inventors: Richard A. Jordan; John P. McHugh, both of Indianapolis, Ind.

[73] Assignee: Solar Suede Corporation, Lexington, Ky.

[21] Appl. No.: 738,393

[22] Filed: Nov. 3, 1976

[51] Int. Cl.[2] ..... B05B 5/00

[52] U.S. Cl. ..... 239/15; 239/518

[58] Field of Search ..... 239/3, 15, 432; 361/227; 118/647, 648; 239/518

[56] References Cited

U.S. PATENT DOCUMENTS

| | | | |
|---|---|---|---|
| 2,718,207 | 9/1955 | Garrison | 118/309 |
| 3,521,125 | 7/1970 | Nelson | 239/15 X |
| 3,551,178 | 12/1970 | Chmelar | 239/15 X |
| 3,575,344 | 4/1971 | Angelico | 239/15 |
| 3,676,194 | 7/1972 | Probst | 239/15 X |
| 3,680,779 | 8/1972 | Reilly | 239/15 X |

*Primary Examiner*—Joseph F. Peters, Jr.
*Assistant Examiner*—Michael Mar
*Attorney, Agent, or Firm*—Jenkins, Coffey & Hyland

[57] ABSTRACT

An electrostatic flocking system having a supply hopper for controllably entraining flock fibers within a propelling air stream, and for feeding the entrained fibers to an electrostatic flocking gun. The fibers and propelling air pass through the gun and into a nozzle at the front of the gun having an elongated forwardly open chamber. An elongated electrode is carried within the nozzle chamber and is coupled to a suitable electric power source for electrostatically charging the fibers and for directing them forwardly over the entire length of the chamber toward the surface of an article being coated.

13 Claims, 9 Drawing Figures

ELECTROSTATIC FLOCKING SYSTEM

BACKGROUND OF THE INVENTION

This invention relates to electrostatic flocking systems. More specifically, this invention relates to an improved electrostatic flocking system having an electrostatic gun with a nozzle for use in applying flock fibers to relatively extensive surface areas.

A wide variety of electrostatic flocking systems and equipment therefor is available throughout the prior art. Typically, such systems comprise flock supply equipment such as air pumps, fluidic beds, etc. for entraining flock fibers within a propelling air stream and for carrying the fibers to an electrostatic flocking gun. There, the entrained flock fibers are electrostatically charged and are carried by the electrostatic field and/or the propelling air stream toward an electrically grounded adhesive coated surface of an article being coated. See, for example, U.S. Pat. No. 3,551,178.

In the prior art, some electrostatic flocking guns have included a nozzle for causing the charged flock fibers to assume a specific geometric spray pattern upon exiting the gun. See, for example, U.S. application Ser. No. 673,439, filed Apr. 5, 1976, now abandoned, and U.S. application Ser. No. 724,029, filed Sept. 16, 1976, both of which are owned by the assignee of this application. However, these and other prior art nozzles have not successfully provided apparatus for spreading charged flock fibers into a relatively extensive geometric pattern for use in flocking correspondingly extensive surface areas. Accordingly, when flocking extensive surface areas such as a wall or the like, many passes of the flocking gun over the surface have been required in order to obtain a complete, uniformly dense flock coating. This procedure is relatively time-consuming, and requires a relatively high degree of operator skill to prevent erratic flock coatings.

This invention overcomes the problems of the prior art by providing an electrostatic flocking system having an electrostatic gun with a nozzle for use in quickly and uniformly flocking extensive surface areas.

SUMMARY OF THE INVENTION

In accordance with the invention, an electrostatic flocking system is provided having flock supply means such as a hopper and air pump for controllably feeding flock fibers into an entraining air stream for carrying the fibers through the barrel passage of an electrostatic flocking gun. The gun has a nozzle at the exit end thereof comprising an elongated housing of a relatively long width and comparatively short height. The housing has a forwardly open elongated chamber in open communication with the gun barrel passage whereby the fibers and propelling air stream pass into the chamber. The rear wall of the nozzle housing within the chamber is lined with an elongated electrode strip. The electrode strip is electrically coupled by charging means through the flocking gun to a suitable power supply. Thus, the flock fibers passing into the chamber are electrostatically charged over the entire length of the chamber, and are directed forwardly from the chamber in a substantially uniformly dispersed low-profile spray pattern toward an article being coated.

BRIEF DESCRIPTION OF THE DRAWINGS

The accompanying drawings illustrate the invention. In such drawings.

DETAILED DESCRIPTION OF THE PREFERRED EMBODIMENT

Figure 1:
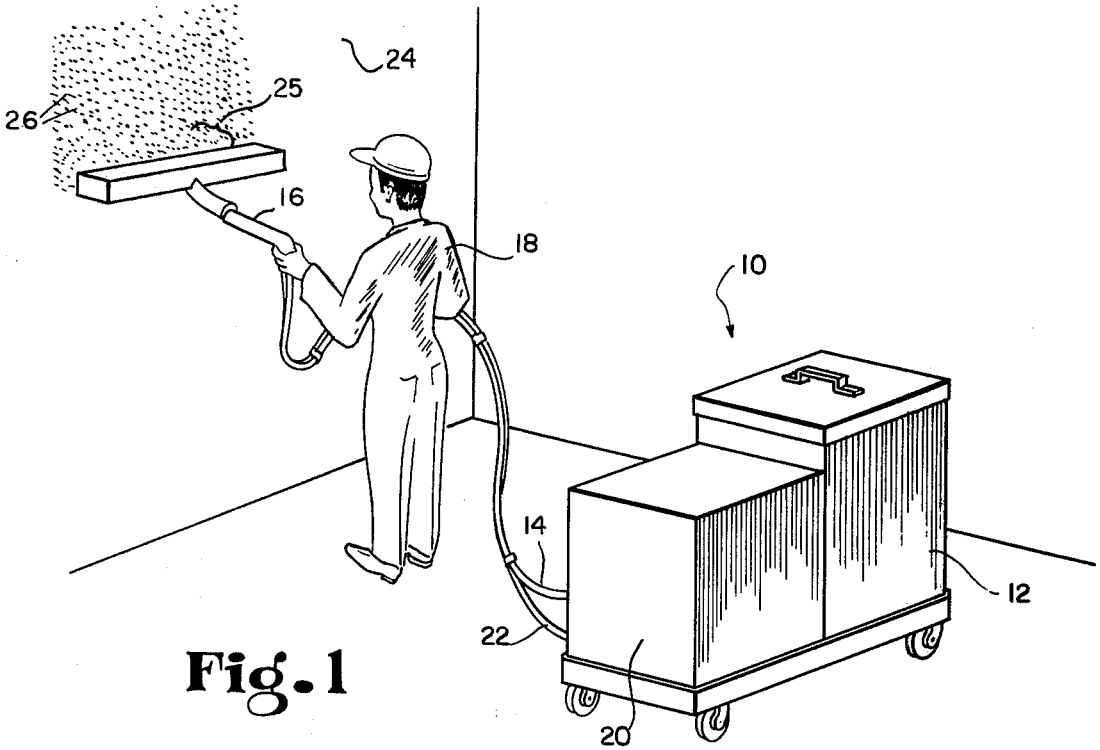
FIG. 1 is a perspective view illustrating an electrostatic flocking system of this invention.

An electrostatic flocking system is shown in FIG. 1, and generally comprises a hopper 12 for storing a supply of flock fibers and for supplying the flock fibers through flexible tubing 14 to an electrostatic flocking gun 16. The gun 16 is hand-held by an operator 18, and is supplied with electrical power from a suitable source such as a D.C. power supply 20 through an electrical conductor 22. The flock fibers are sprayed outwardly from the gun 16 toward a surface being coated, such as a wall 24. Conveniently, the wall 24 is coated with an electrically conductive, grounded adhesive (not shown) so that an electrostatic field 25 extends between the gun 16 and the coated wall 24. In this manner, charged flock fibers 26 exiting the gun 16 are electrostatically attracted to the wall 24 and become fixedly bonded thereto. Importantly, the electrostatic field 25 tends to urge the fibers 26 to orient themselves so that they strike the coated wall end first.

Figure 2:
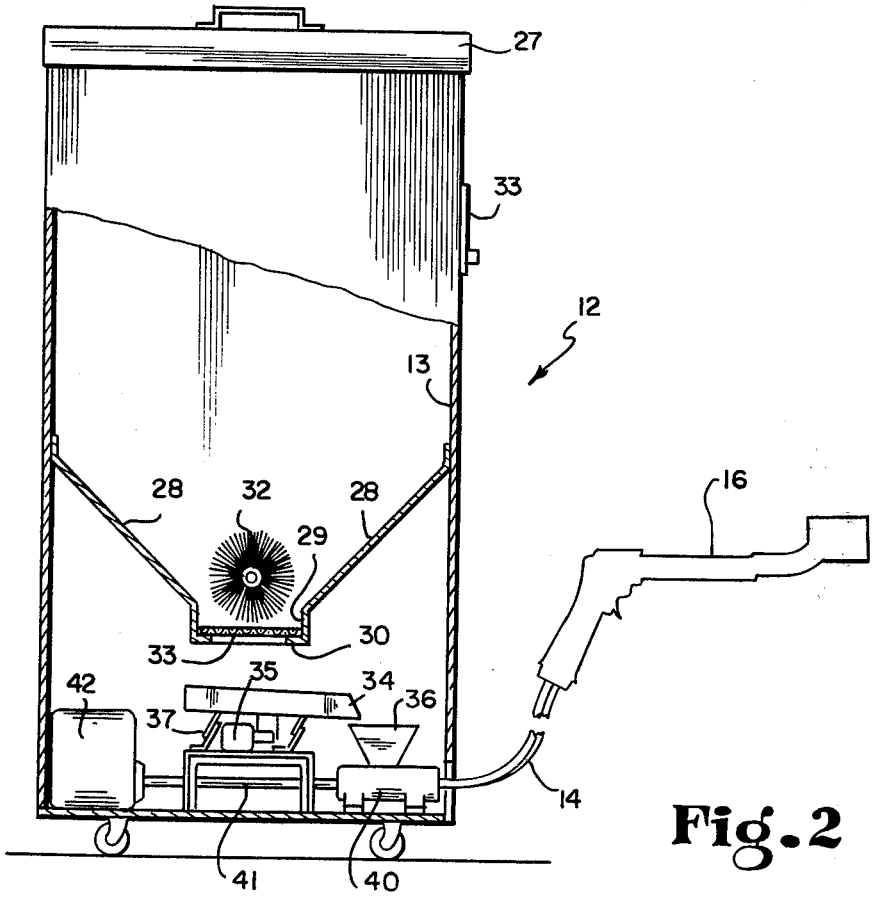
FIG. 2 is an enlarged elevation view showing apparatus for supplying flock fibers to a flocking gun, with portions thereof broken away.

The storage hopper 12 is shown in detail in FIG. 2, and comprises a storage chamber 13 with a removable lid 27 to permit refilling thereof. The bottom of the storage chamber 13 is closed by downwardly and inwardly angled walls 28 whose lower ends are spaced from each other to define a discharge passage 29. The discharge passage is covered by a screen 30 through which the flock fibers are urged to fall by an overlying, rotating brush 32. The brush is rotatably driven by a motor (not shown) and controlled through a control panel 33 on the outside of the hopper 12.

The flock fibers fall at a controlled rate through the screen 30 and onto an elongated trough 34 carried on movable supports 37 and vibrated by a motor 35. The trough 34 is angled slightly downwardly so that fibers thereon are shaken into a collecting funnel 36. The funnel 36 feeds the fibers into an air flow pump 40 which is fed with a stream of air through tubing 41 from an air compressor 42. The air stream flows through the flow pump 40, which can include an accelerating venturi (not shown), to pick up and entrain the falling rock fibers in the air stream. From the pump 40, the air stream and entrained fibers flow through the flexible tubing 14 to the flocking gun 16. While the specific construction of the flow pump 40 is not shown in detail, a flow pump such as that described in above-mentioned application Ser. No. 724,029 is preferred.

Figures 3, 4, 5, 6:
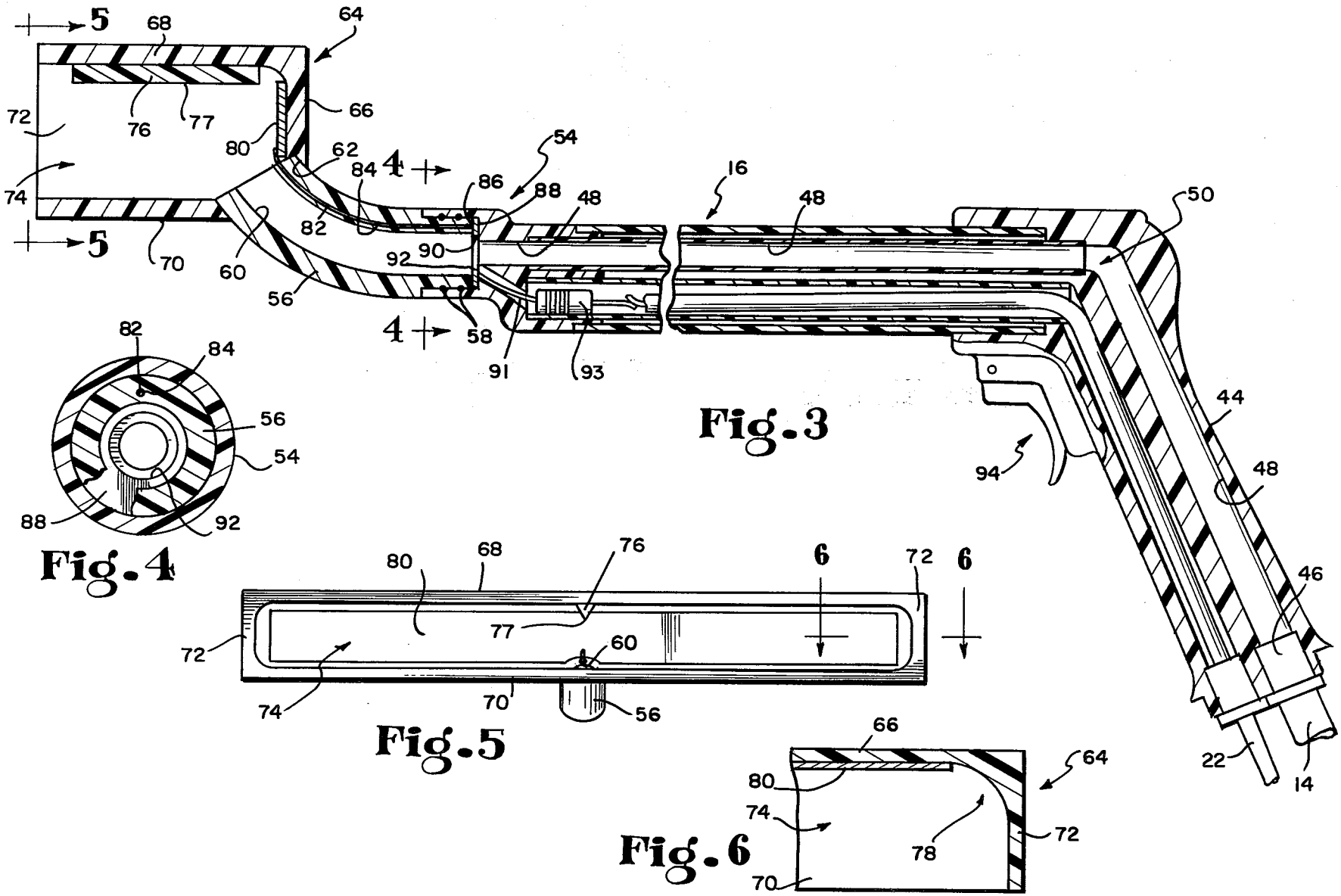
FIG. 3 is an enlarged sectional view of the flocking gun of FIG. 1.
FIG. 4 is a vertical section taken on the line 4—4 of FIG. 3.
FIG. 5 is a front elevation view of the flocking gun taken on the line 5—5 of FIG. 3.
FIG. 6 is an enlarged fragmented horizontal section taken on the line 6—6 of FIG. 5.

The flocking gun 16 is shown in detail in FIG. 3, and comprises a gun body having a handle 44 with a fitting 46 at the base thereof for reception of one end of the flexible flock-carrying tubing 14. The flock fibers and propelling air stream pass through the fitting 46 and through a barrel passage 48 within the gun handle 44. The barrel passage extends upwardly within the handle 44, and then turns forwardly, as at 50, toward the front or exit end of the gun. Conveniently, this angular turn of the barrel passage 48 helps to slow down the flock fibers and air stream, and thereby helps to prevent excessive bouncing of flock fibers off the surface being coated as will hereafter be described in more detail.

The flock fibers and propelling air stream exit the gun 16 through a nozzle 52, as shown in FIGS. 3, 5, and 6. More specifically, the gun 16 has a forward tip 54 of expanded inside diameter. The tip 54 slidably receives one end of a nonconductive connector tube 56, which conveniently has axially spaced O-ring seals 58 carried thereabout for assuring a rotatable sealing fit between the tip 54 and the connector tube 56. The connector tube extends forwardly from the gun tip 54 and then angularly upwardly, and has an opening 60 therethrough whereby the flock fibers and propelling air stream are also directed forwardly and angularly upwardly.

The connector tube 56 is fixedly received in any suitable manner in an opening 62 at the lower rear corner of a nozzle housing 64 of rectangular cross section. The housing 64, which is formed from a lightweight nonconductive material, is transversely elongated with the connector tube 56 being fixed intermediate the housing length. The housing has a rear wall 66, a top wall 68, a bottom wall 70, and opposed side walls 72 defining a transversely elongated, forwardly open chamber 74. Conveniently, the curvature of the connector tube 56 is such that the rear wall 66 of the housing 64 extends vertically when the gun 16 is horizontally aimed. In this manner, the housing chamber 74 is forwardly open regardless of the rotatable position of the connector tube 56 with respect to the forward tip 54 of the gun 16.

The flock fibers and the propelling air stream travel through the connector tube 56 forwardly and angularly upwardly into the transverse center of the chamber 74. There, the fibers and air strike a forwardly extending diffuser bar 76 of triangular cross section mounted on the underside of the housing top wall 68. The diffuser bar 76 is positioned in alignment with the connector tube opening 60 and provides a downwardly presented edge 77 serving to divide the incoming fibers and air stream into two substantially equal fiber-air flow streams. The respective flow streams are directed by the diffuser bar 76 toward opposite side walls 72 within the chamber 74. Conveniently, as shown in FIGS. 5 and 6, the rear wall 66 and the top and bottom walls 68 and 70 curvedly blend into the side walls 72, so that the flow streams at the opposed sides of the chamber are turned forwardly.

The rear wall 66 of the housing 64 within the chamber 74 is lined with an elongated electrode strip 80 of metal foil or the like. As shown in FIGS. 3 and 4, this electrode strip 80 is electrically connected to a conductor, or probe 82, received through a small passage 84 in the wall of the connector tube 56. The probe 82 is in turn connected electrically by virtue of a bead 86 on the end thereof in contact with a metal washer 88 interposed between the connector tube 56 and a forwardly presented shoulder 90 of the gun tip 54. The washer 88 has an opening 92 concentrically aligned with the gun barrel passage 48 to allow the fibers and air to pass therethrough, and is electrically connected by a lead 91 through a resistor 93 and a manually operable trigger assembly 94 to the power supply conductor 22 at the base of the gun handle 44.

In operation of the flocking system of this invention, the flock fibers and the propelling air stream together flow into the nozzle chamber 74 and are split into two equal density flows directed toward the opposed side walls 72 of the chamber. As the fibers pass in close proximity with the electrode strip 80, the strip when charged serves to electrostatically charge the fibers. When the chamber is held near a grounded surface being coated, such as the wall 24 in FIG. 1, an electrostatic field is set up between the surface being coated and the electrode strip. This field attracts the fibers as a low-profile, substantially uniform density spray pattern toward the surface being coated. Importantly, this spray pattern has a width and a height corresponding to the transverse length and the height of the chamber 74.

The specific dimensions of the nozzle housing 64 and the chamber 74 formed therein are variable according to the type and weight of the fibers used together with the velocity of the propelling air stream and the desired width of spray pattern. In one specific working embodiment using nylon fibers having a length of about 0.05 inches and a weight of about 6.0 denier, together with an air flow rate of about 3.0 cubic feet per minute, the housing chamber had a transverse dimension of 2.0 feet and a height of about 1.0 inch. The nozzle 64 provided a low-profile flock spray pattern of uniform density having a height substantially equal to the chamber height and a width substantially equal to the transverse chamber length. Of course, it will be appreciated that the specifications mentioned are merely illustrative, with the fiber length and weight being variable through ranges of at least between about 0.010 and 0.250 inch and between about 1.5 and 30.0 denier. Further, it is believed that the housing chamber length is variable up to at least about 12.0 feet, and the chamber height is variable at least within the range of between about 0.5 inch and 3.0 inches.

The electrostatic flocking system of this invention is particularly useful for flocking relatively extensive surface areas such as the wall 24 shown in FIG. 1. The nozzle housing 64 provides a wide flock fiber spray pattern of substantially uniform density to enable a wide portion of the wall 24 to be coated with a single pass of the gun 16. Further, when held close to the wall 24, the elongated housing 64 serves to entrap that portion of the flock fibers which bounces back from the wall or otherwise loses the charge and does not become embedded in the adhesive coating. By trapping these loose fibers, they are maintained within the electrostatic field 25 between the housing 64 and the wall 24, and are thereby recharged and redirected toward the wall for deposition thereon. In this manner, this invention provides a flock coating of improved quality with minimum wasting of fibers.

Figure 7:
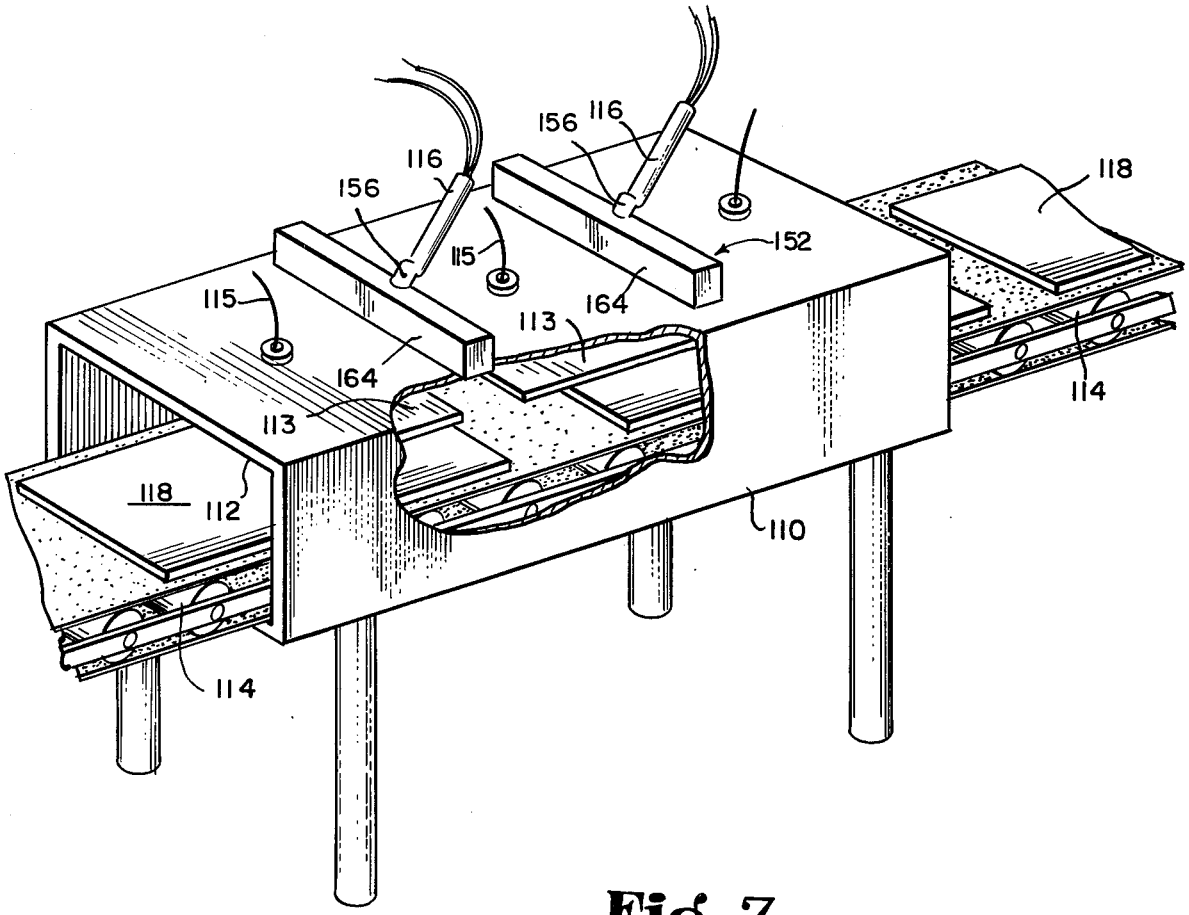
FIG. 7 is a fragmented perspective view showing an alternate embodiment of the flocking system of this invention, with portions thereof broken away.

An alternate embodiment of the electrostatic flocking system of this invention is shown in FIG. 7. As shown, a plurality of elongated nozzles 152 are mounted on a conveyor housing 110 having a passage 112 therethrough. A conveyor 114 extends through the conveyor housing 110 for moving a series of panels 118 or the like through the passage 112. Conveniently, the conveyor has a plurality of secondary electrodes 113 mounted therein and supplied with electrical power by conductors 115 for providing a secondary charging effect as described in copending application Ser. No. 694,654, which is owned by the assignee of this application. Each of the nozzles 152 comprises an elongated nozzle housing 164 of the same general construction as the nozzle housings 64 of FIGS. 3, 5 and 6. Each nozzle housing extends transversely of the conveyor housing 110, with the nozzle housings 164 being longitudinally spaced along the length of said conveyor housing. The nozzle housings 164 each have connector tubes 156 for reception into a removably mounted electrostatic charging gun 116 which operates in the same manner as the previous embodiment to supply the nozzle housing with electrical power and flock fibers entrained in a propelling air stream. Said nozzle housings 164 have elongated chambers (not shown) therein in communication with the upwardly presented surfaces of the panels 118 passing therebelow. Thus, the nozzles 152 are effective to provide relatively wide spray patterns of flock fibers for flocking the upwardly presented surfaces of the panels 118.

Figure 8:
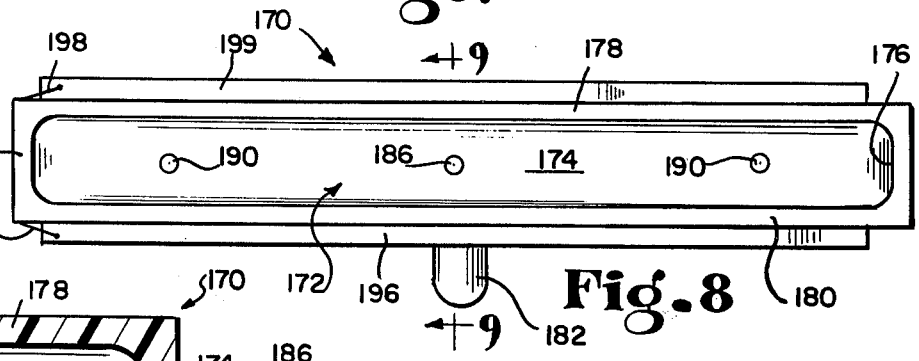
FIG. 8 is a front elevation view similar to FIG. 5 of an alternate embodiment of the system of this invention.
Figure 9:
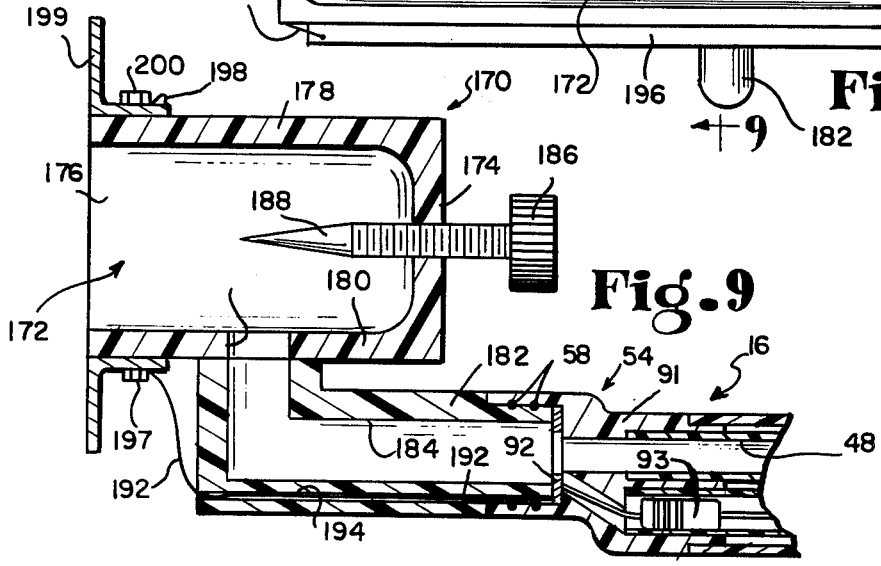
FIG. 9 is an enlarged fragmented vertical section taken on the line 9—9 of FIG. 8.

Another alternate embodiment of the electrostatic flocking system of this invention is shown in FIGS. 8 and 9. As shown, a nozzle 170 is provided having a transversely elongated, forwardly open chamber 172 defined by a rear wall 174, side walls 176, and top and bottom walls 178 and 180. A connector tube 182 has one end extending downwardly from the bottom wall 180 at the transverse center of the nozzle, and then turned rearwardly for connection to a gun 16. More specifically, the connector tube has a rear end slidably received in the enlarged tip 54 of the gun, with O-ring seals 58 being provided to assure a rotatable sealing fit. The connector tube provides a passage 184 for directing flock fibers and the propelling air stream from the gun upwardly into the nozzle chamber 172.

A control screw 186 of plastic or the like is threadably carried within the rear wall 174 of the nozzle 170 above the passage 184 opening into the chamber 172. The control screw 186 has a forwardly projecting needle 188 disposed generally above the connector tube passage 184 so that the flock fibers and air stream entering the chamber strike said needle. The control screw 186 thereby serves to deflect the fibers and air stream toward the opposed side walls 176 of the nozzle, with the degree of deflection being dependent upon the position of adjustment of the control screw 186. That is, as the needle 188 of the control screw 186 is moved further forwardly over the connector tube passage 186, the ability of the screw to deflect and spread the incoming fiber and air stream increases.

Two additional control screws 190 are provided generally midway between the central control screw 186 above the connector tube 182 and the nozzle side walls 176. The additional control screws are identical in construction and operation to the control screw 186 described above, and serve to help direct the fiber and air stream forwardly from the nozzle and toward a surface being flocked. In this manner, a uniform flock spray pattern is assured, and any tendency of the fibers and air to travel to the side walls 176 before turning forwardly is alleviated.

An alternate electrode construction is also shown in FIGS. 8 and 9. As shown, a probe 192 is electrically connected to the washer 92 within the gun tip 54, and said probe extends fowardly through a passage 194 in the connector tube 182. The probe 192 exits the connector tube, and is connected to a transversely extending bottom electrode 196 mounted on the bottom exterior of the nozzle bottom wall 180 at the front thereof by screws 197. This bottom electrode is electrically connected by a conductor 198 to a transversely extending upper electrode 199 similarly mounted on the nozzle top wall 178 by screws 200. With this construction, the operation of the system is substantially the same as with the previous embodiment, with the electrodes 196 and 199 setting up an electrostatic field for directing the flock fibers toward the surface of an article being coated.

Various other modifications of the flocking system of this invention are possible. For example, the flock fibers need not be introduced into the transverse center of the nozzle chamber, but instead can be introduced into the end or at any other point along the nozzle chamber. When so modified, the position of the diffuser bar or control screws can be altered or eliminated as needed to obtain relatively uniform flock density along the chamber. Further, where an extremely wide spray pattern or a spray pattern of unusually high fiber density is desired, a plurality of flocking guns can be used to introduce fibers into the nozzle chamber.

We claim:

1. An electrostatic flocking system comprising an electrostatic flocking gun having a barrel passage with an inlet end and a front exit end; means for entraining flock fibers in an air stream; means for coupling the entrained flock fibers and air stream to the inlet end of said barrel passage whereby the fibers and air stream flow through said barrel passage; a nozzle mounted on said gun at the exit end of said barrel passage and having an elongated chamber open along the elongated dimension thereof and in communication with said barrel passage; diffuser means within said chamber in the path of the air stream and entrained fibers passing into said chamber for creating diverging paths of air and entrained fibers and substantially uniform fiber density along the elongated dimension of said chamber; an elongated electrode strip mounted on said nozzle and extending along said chamber; and means for electrically charging said strip so that flock fibers passing from said barrel passage into said chamber are electrostatically charged.

2. An electrostatic flocking system as set forth in claim 1 wherein said electrode strip is mounted within said chamber.

3. An electrostatic flocking system as set forth in claim 1 wherein said chamber comprises a transversely elongated forwardly open housing having top, bottom, and rear walls curvedly blending into said opposed side walls, whereby the air stream and entrained fibers flowing into said chamber are deflected toward said side walls where they are directed forwardly.

4. An electrostatic flocking system as set forth in claim 3 wherein said electrode strip is mounted on the rear wall of said housing within said chamber.

5. An electrostatic flocking system comprising an electrostatic flocking gun having a barrel passage with an inlet end and a front exit end; means for entraining flock fibers in an air stream; means for coupling the entrained flock fibers and air stream to the inlet end of said barrel passage whereby the fibers and air stream flow through said barrel passage; a nozzle mounted on said gun at the exit end of said barrel passage and having an elongated chamber open along the elongated dimension thereof and in communication with said barrel passage; diffuser means within said chamber for splitting the flow of entrained fibers and air passing into said chamber, said diffuser means comprising a control screw mounted on said nozzle and having a needle projecting into said chamber, said control screw being adjustable for varying the position of said needle within said chamber for selectively obtaining a substantially uniform fiber density along the entire length of said chamber; an elongated electrode strip mounted on said nozzle and extending along said chamber; and means for electrically charging said strip so that flock fibers passing from said barrel passage into said chamber are electrostatically charged.

6. An electrostatic flocking system as set forth in claim 5 wherein said diffuser means comprises a plurality of control screws mounted on said nozzle and spaced along the length thereof, said control screws each having a needle projecting into said chamber and being adjustable for varying the position of said needle within said chamber.

7. An electrostatic flocking gun as set forth in claim 5 wherein said electrode strip is mounted within said chamber.

8. In an electrostatic flocking system having flock supply means having an opening for passage therethrough of flock fibers entrained in an air stream, a nozzle for mounting on said supply means comprising a housing having an elongated chamber open along the elongated dimension thereof and in communication with the supply means opening when said nozzle is mounted on said supply means; diffuser means within said chamber for splitting the flow of entrained fibers and air passing into said chamber to obtain substantially uniform fiber density along the entire length of said chamber, said diffuser means comprising a control screw mounted on said housing and having a needle projecting into said chamber, said control screw being adjustable with respect to said housing for controlling the portion of said needle within said chamber, an elongated electrode strip mounted on said housing and extending for substantially the entire length of said chamber; and charging means for electrically connecting said electrode strip to an electrical power source for electrostatically charging the flock fibers over substantially the entire length of said chamber.

9. A nozzle as set forth in claim 8 wherein said diffuser means comprises a plurality of control screws mounted on said housing and spaced along the length thereof, each of said control screws having a needle projecting into said chamber and being adjustable with respect to said housing for controlling the position of said needle within said chamber.

10. A nozzle as set forth in claim 8 wherein said electrode strip is mounted within said chamber.

11. A nozzle as set forth in claim 8 wherein said housing is transversely elongated, and has a top wall, a bottom wall, a rear wall, and opposed side walls forming said chamber, said top, bottom, and rear walls being shaped to curvedly blend into said side walls at the opposed sides of said housing whereby the fibers and air flowing into said chamber are directed forwardly at the opposed sides of said housing.

12. In an electrostatic flocking system having an electrostatic flocking gun with a barrel passage having an inlet end and a front exit end for passage therethrough of flock fibers entrained in an air stream, a nozzle for mounting on the gun at the exit end of the barrel passage comprising a housing having a transversely elongated forwardly open chamber in communication with the barrel passage when said nozzle is mounted on the gun; an elongated electrode strip mounted on said housing and extending substantially the entire length of said chamber; a connector tube connected to said housing intermediate the ends of said chamber and for connection to said gun to provide to flow path from the barrel passage to said chamber; diffuser means mounted on said housing with said chamber for splitting the flow of entrained fibers and air passing into said chamber to obtain diverging paths of air and entrained fibers and substantially uniform flock density along the entire length of said chamber; and an electrical conductor carried by said connector tube for electrically connecting said electrode strip to an electrical power source for electrostatically charging the flock fibers over substantially the entire length of said chamber.

13. An electrostatic flocking system comprising an electrostatic flocking gun having a nozzle with an elongated chamber opening along the elongated dimension thereof; means for entraining flock fibers in an air stream; inlet means for delivering the entrained flock fibers and air stream to said nozzle generally transversely to the elongated dimension of the chamber opening; diffuser means extending generally transversely with respect to said inlet means for creating diverging paths of air and entrained fibers and directing them with substantially uniform fiber density along the elongated dimension of said chamber; and means for electrically charging said flock fibers.

* * * * *

UNITED STATES PATENT OFFICE

CERTIFICATE OF CORRECTION

Patent No. 4,146,177 Dated March 27, 1979

Inventor(s) Richard A. Jordan and John P. McHugh

It is certified that error appears in the above-identified patent and that said Letters Patent are hereby corrected as shown below:

Column 2, line 64, change "rock" to --flock--.

Column 8, line 26, (claim 12), change "to flow" to --a flow--;

line 28, (claim 12), change "with" to --within--.

Signed and Sealed this

Eleventh Day of September 1979

[SEAL]

Attest:

Attesting Officer

LUTRELLE F. PARKER

Acting Commissioner of Patents and Trademarks